US007083296B2

(12) United States Patent
Chiang

(10) Patent No.: US 7,083,296 B2
(45) Date of Patent: Aug. 1, 2006

(54) FLASHING DEVICE

(76) Inventor: Chuan-Tai Chiang, No. 73, Sec.2, He-Bei Rd., Taichung City (TW)

( * ) Notice: Subject to any disclaimer, the term of this patent is extended or adjusted under 35 U.S.C. 154(b) by 70 days.

(21) Appl. No.: 10/849,908

(22) Filed: May 21, 2004

(65) Prior Publication Data

US 2005/0259410 A1 Nov. 24, 2005

(51) Int. Cl.
*F21V 21/08* (2006.01)
*A43B 23/00* (2006.01)

(52) U.S. Cl. ..... 362/103; 36/137

(58) Field of Classification Search ..... 362/103; 36/137

See application file for complete search history.

(56) References Cited

U.S. PATENT DOCUMENTS 5,052,131 A * 10/1991 Rondini ..... 36/137
5,128,843 A * 7/1992 Guritz ..... 362/103
5,613,756 A * 3/1997 Allen ..... 362/103
5,894,686 A * 4/1999 Parker et al. ..... 36/137
6,112,437 A * 9/2000 Lovitt ..... 36/137
6,193,385 B1 * 2/2001 Maki et al. ..... 362/108
6,874,904 B1 * 4/2005 Hsu ..... 362/84
2003/0145494 A1 * 8/2003 Hsu ..... 36/137
2004/0046502 A1 * 3/2004 Chien ..... 313/512
2005/0018417 A1 * 1/2005 Chien ..... 362/103
2005/0152142 A1 * 7/2005 Traynor ..... 362/249

* cited by examiner

*Primary Examiner*—Renee Luebke
*Assistant Examiner*—David Makiya
(74) *Attorney, Agent, or Firm*—Rosenberg, Klein & Lee

(57) ABSTRACT

A flashing device includes two plates and each plate includes a plurality conductive lines printed thereon and a plurality of LEDs are connected to each of the two plates and electrically connected to the conductive lines. Two transparent isolation sheets sandwich the each plate and a plurality of lead wires are connected between the conductive lines and a control circuit which is connected to a switch device powered by a power supply. The LEDs light up when the switch such as a pressure switch is activated.

5 Claims, 5 Drawing Sheets

FLASHING DEVICE

FIELD OF THE INVENTION

The present invention relates to a flashing device including a switch for controlling LEDs which are powered by direct current at low voltages.

BACKGROUND OF THE INVENTION

A conventional flashing device usually connected to shoes, hats or backbags includes a circuit which powers flashing members by direct currents. Nevertheless, the flashing members of the device generates luminescence which is dim and cannot satisfy the users. In order to increase the flashing effect, a boost up circuit has to be used. However, the boost up circuit tends to be suffered by leakage. U.S. Pat. No. 5,709,464 discloses a flashing light circuit structure that employs light emitting diodes (LEDs) controlled by an integral circuit. The LEDs are not spread on any object so that it takes a lot of time to positioning the LEDs on the object such as shoes or hats, and the LEDs are easily broken by foreign impacts.

The present invention intends to provide a flashing device wherein the LEDs are connected to a plate which is received in a transparent envelope, and to an integral circuit by wires. A switch is connected to the wire so as to activate the LEDs.

SUMMARY OF THE INVENTION

The present invention relates to a flashing device that comprises at least one plate on which a plurality conductive lines are printed. A plurality of LEDs are connected to the at least one plate and electrically connected to the conductive lines. Two transparent isolation sheets sandwich the at least one plate therebetween. A plurality of lead wires are connected between the conductive lines and a control circuit which is connected to a switch device powered by a power supply.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
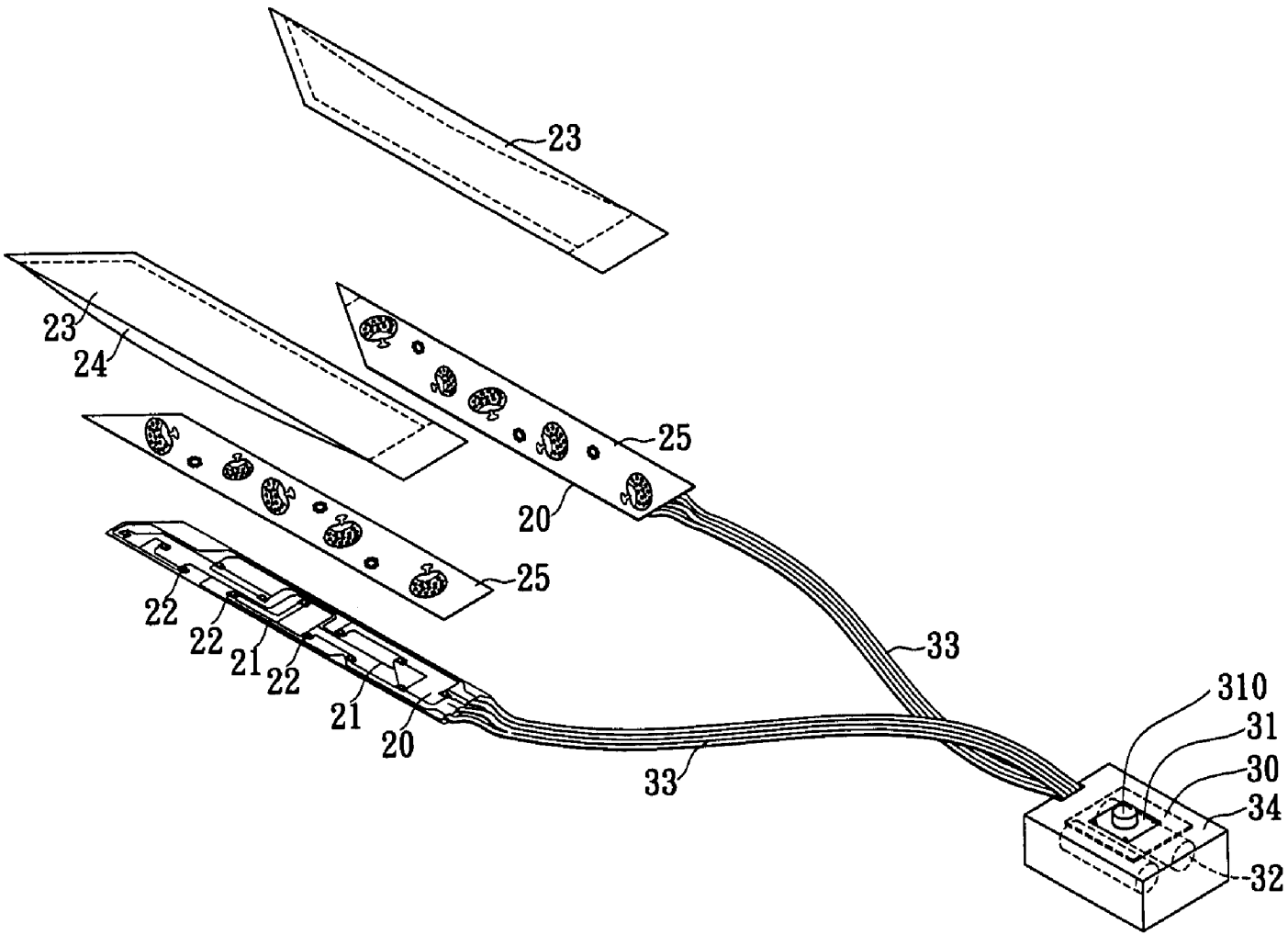
FIG. 1 is an exploded view to show the flashing device of the present invention.
Figure 2:
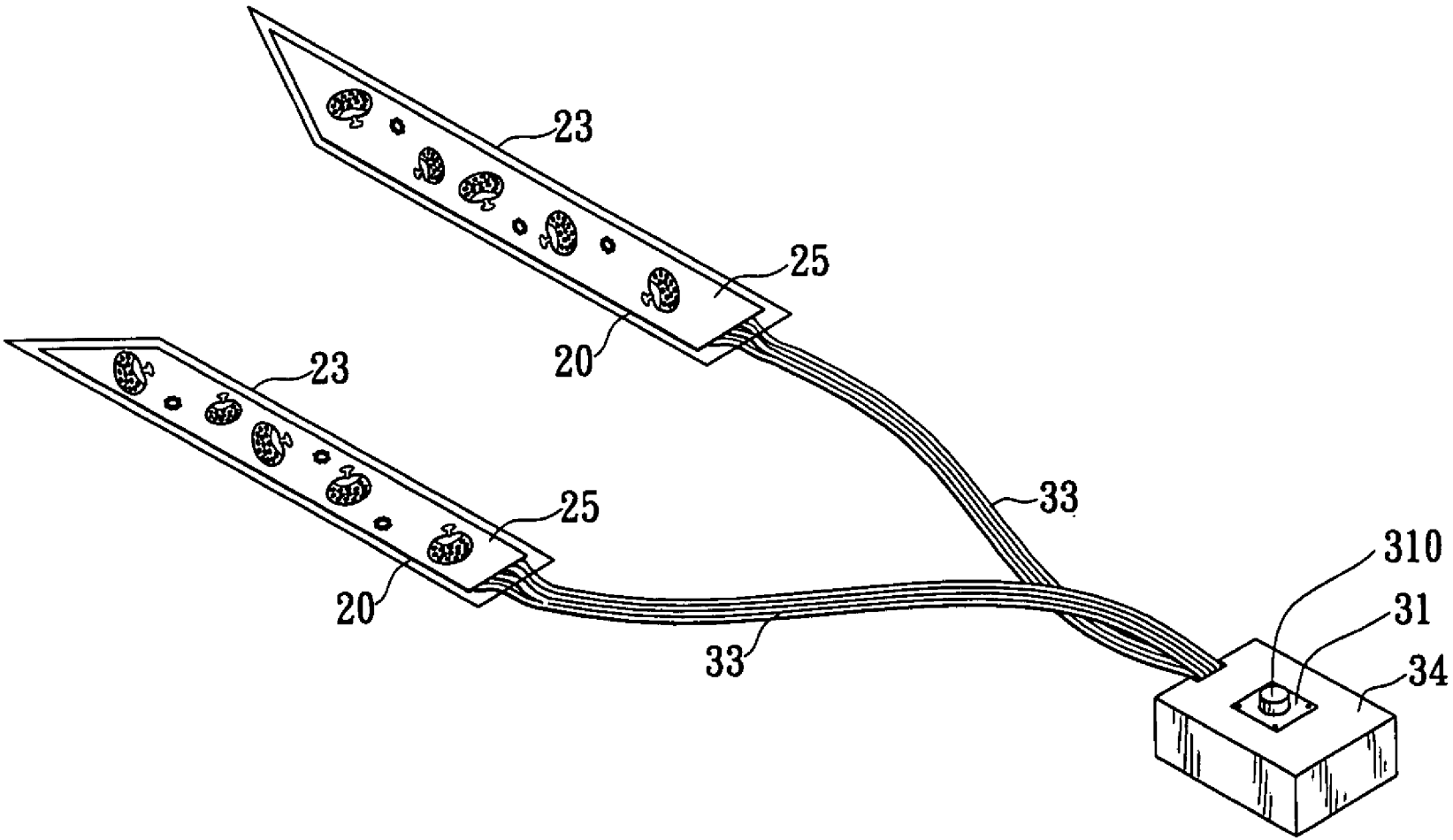
FIG. 2 is a perspective view to show the flashing device of the present invention.
Figure 3:
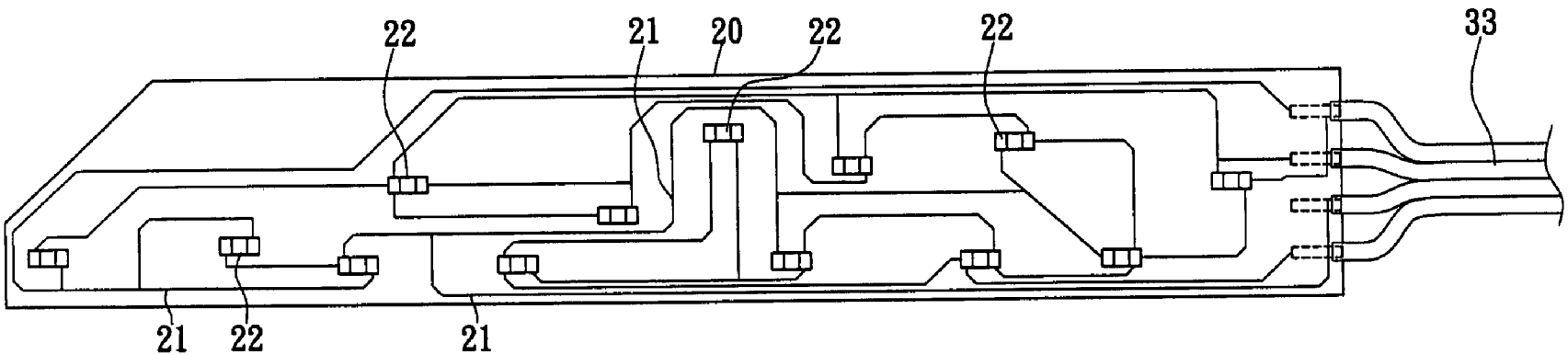
FIG. 3 shows the arrangement of the LEDs and the conductive lines in the plate.
Figure 4:
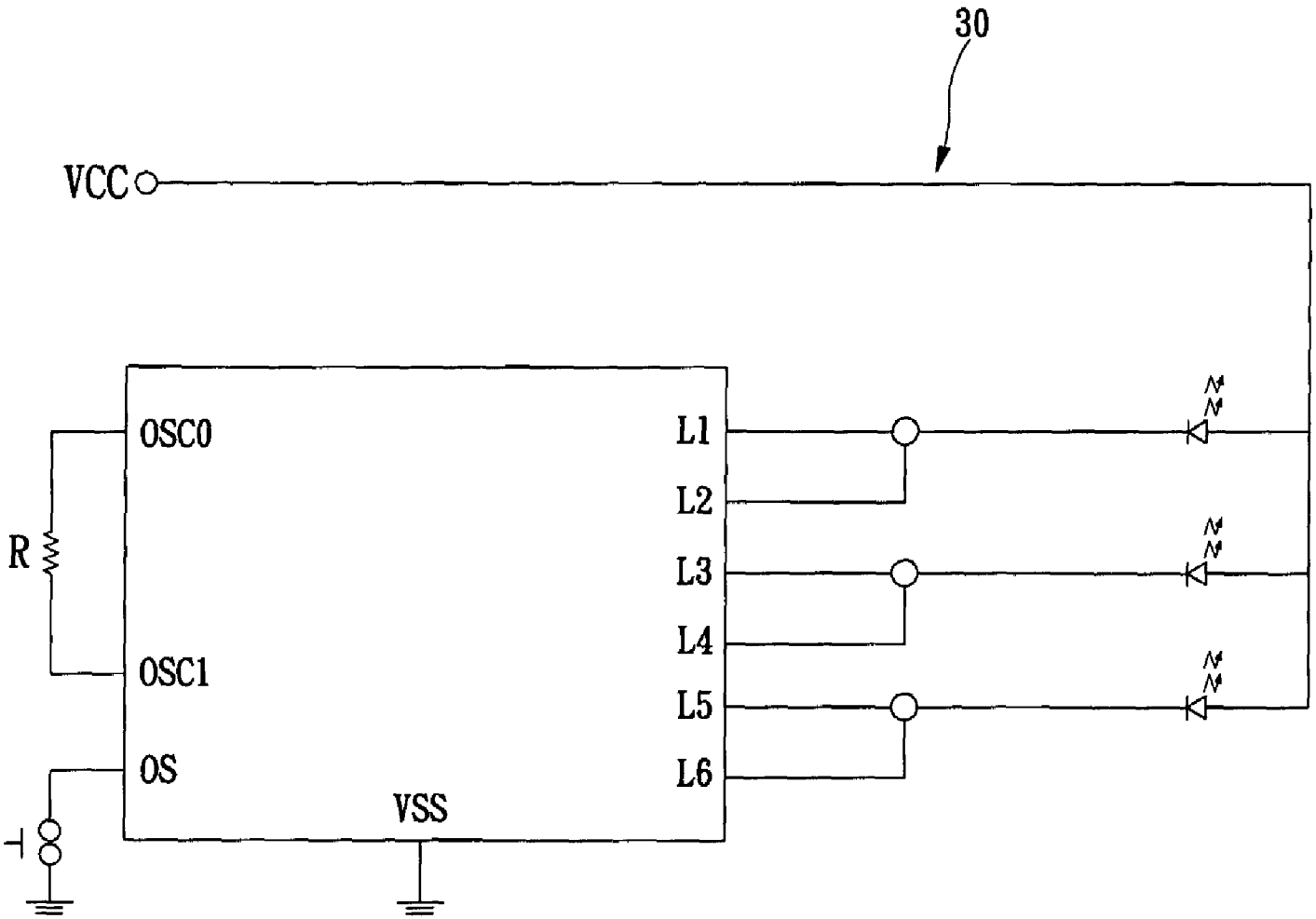
FIG. 4 shows the control circuit.

Referring to FIGS. 1 to 4, the flashing device of the present invention comprises two flexible plates 20 and a plurality conductive lines 21 are printed each of the two plates 20. A plurality of LEDs 22 are connected to each of the two plates 20 and electrically connected to the conductive lines 21 in parallel or in series.

Two isolation sheets 23, 24 sandwich each of the two plates 20 therebetween, and a transparent pattern sheet 25 including patterns printed thereon is attached to each of the plates 20. Light of the LEDs displays the patterns to attract people's attention. One of the two isolation sheets 23, 24 can be transparent.

A plurality of lead wires 33 are connected between the conductive lines 21 and a control circuit 30 which is an integral circuit and connected to a switch device 31 powered by a power supply 32. The switch device 31 can be a pressure switch, a temperature pressure or even a manual switch. The control circuit 30 and the power supply 32 are received in a case 34 and the switch device 31 is connected to the case 34. The switch 31 such as the pressure switch includes a button 310 projecting from a top of the case 34 so that when the button 310 is pushed, the LEDs light up.

Figure 5:
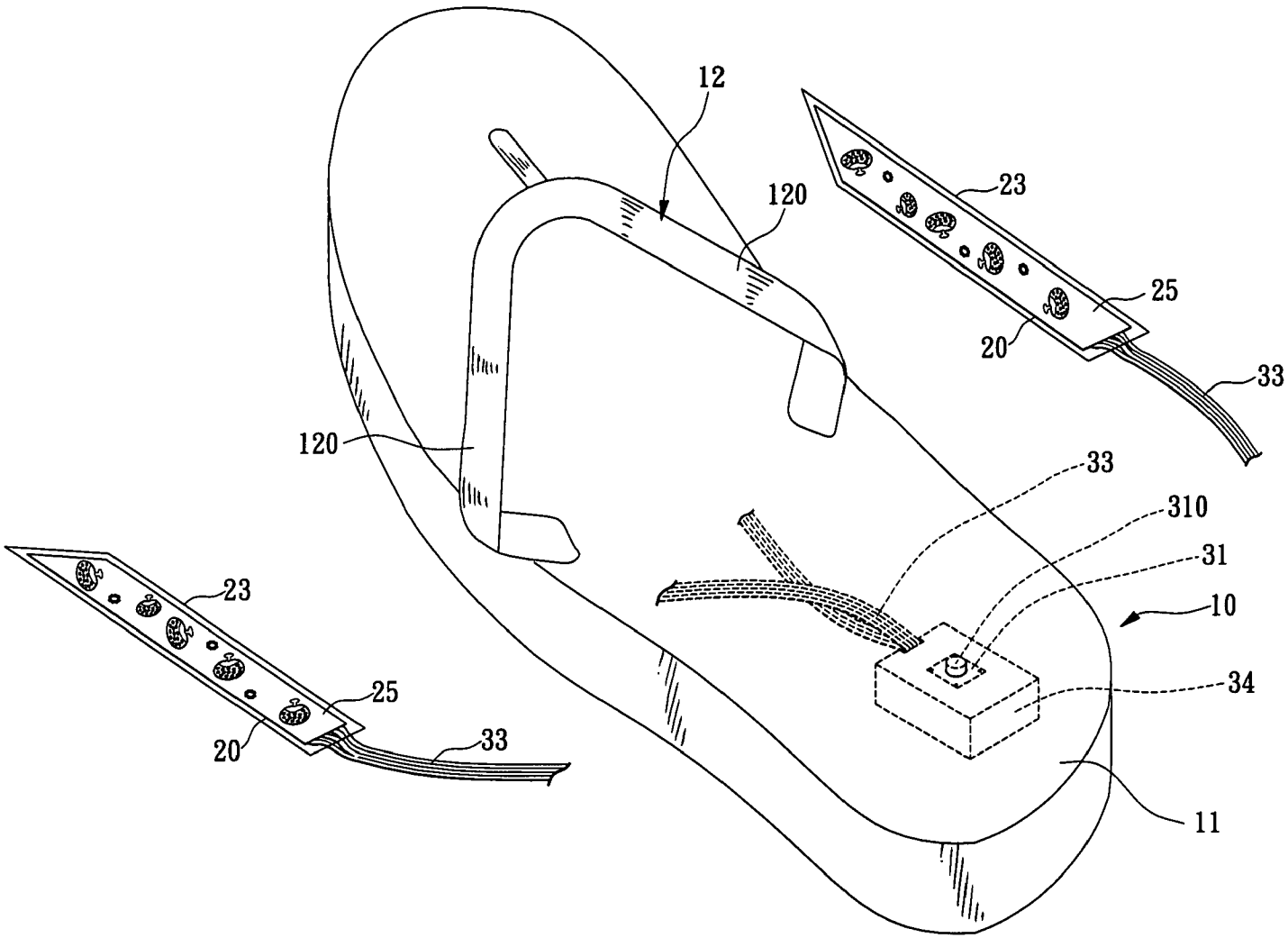
FIG. 5 shows the flashing device and the sandal to be connected with the flashing device.

As shown in FIG. 5, the flashing device can be used on a sandal 10 which includes a sole 11 and a vamp 12 which includes two straps 120 fixed to a top of the sole 11. The two plates 20 are respectively connected to the two straps 12 and the case 34 including the control circuit 30, the switch device 31, and the power supply 32 is embedded in the sole 11. The lead wires 33 are connected between the conductive lines 21 and the control circuit 30. The button 310 projects on the case 34 so that when a wearer steps on the button 310, the LEDs 20 light up and display the patterns on the pattern sheet 25.

The LEDs 22 requires very low power of energy which can be provided by direct current at low voltage. The control circuit 30 is economical and efficient, and is safe to the users.

While we have shown and described the embodiment in accordance with the present invention, it should be clear to those skilled in the art that further embodiments may be made without departing from the scope of the present invention.

What is claimed is:

1. A flashing device comprising:

at least one plate (20) and a plurality conductive lines (21) printed on the at least plate (20), wherein the at least one plate (20) is a flexible plate;

a plurality of LEDs (22) connected to the at least one plate (20) and electrically connected to the conductive lines (21);

two isolation sheets (23) forming an envelope defining a pocket to receive the at least one plate (20) therebetween, one of the isolation sheet (23) being transparent;

at least one transparent pattern sheet (25) disposed over the plate (20), the pattern sheet (25) including patterns printed thereon for illumination by the LEDs (22);

a control circuit (30);

a switch device (31) connected to the control circuit (30);

a power supply (32) connected to the switch device (31);

a plurality of lead wires (33) connected between the conductive lines (21) and the control circuit (30), and a sandal(10) having two straps(12);

wherein the at least one flexible plate (20) is connected to each strap (12) of the sandal (10) and the control circuit (30), the switch device (31), the power supply (32), the lead wires (33) are connected between the conductive lines (21), and the control circuit (30) are embedded in a sole (11) of the sandal (10).

2. The device as claimed in claim 1, wherein the switch device (31) is a pressure switch.

3. The device as claimed in claim 1, wherein the control circuit (30) and the power supply (32) are received in a case (34), the switch device (31) is connected to the case (34).

4. The device as claimed in claim 3, wherein the switch (31) is a pressure switch and includes a button (310) projecting from a top of the case (34).

5. The device as claimed in claim 1, wherein the control circuit (30) is an integral circuit.

* * * * *